United States Patent [19]

Spangenberg et al.

[11] 4,370,216

[45] Jan. 25, 1983

[54] ELECTROLYTIC CELL AND ANODE FOR MOLTEN SALT ELECTROLYSIS

[75] Inventors: Stanley F. Spangenberg; Arlington L. Finley, both of Midland; D. James Searson, Sanford, all of, MI

[73] Assignee: The Dow Chemical Company, Midland, Mich.

[21] Appl. No.: 204,733

[22] Filed: Nov. 6, 1980

[51] Int. Cl.[3] ..... C25C 3/04; C25C 3/06

[52] U.S. Cl. ..... 204/243 R; 204/290 R; 204/291; 204/292; 204/293

[58] Field of Search ..... 204/243 R, 290 R, 291, 204/292, 293, 290 F, 70, 67

[56] References Cited

U.S. PATENT DOCUMENTS

| | | | |
|---|---|---|---|
| 2,979,553 | 4/1961 | McCallum et al. | 136/100 |
| 3,926,773 | 12/1975 | Koziol et al. | 204/290 F |
| 4,003,817 | 1/1977 | Bianchi et al. | 204/290 F |
| 4,070,504 | 1/1978 | Bianchi et al. | 427/126 |
| 4,071,420 | 1/1978 | Foster et al. | 204/67 |
| 4,086,157 | 4/1978 | Koziol et al. | 204/290 F |
| 4,146,438 | 3/1979 | de Nora et al. | 204/65 |
| 4,160,069 | 7/1979 | Johnson et al. | 429/104 |
| 4,187,155 | 2/1980 | de Nora et al. | 204/67 |

FOREIGN PATENT DOCUMENTS 54-144415 11/1979 Japan .

OTHER PUBLICATIONS

Materials Research Bulletin, vol. 12, pp. 861–869, 1977, Pergamon Press.

Journal of Solid State Chemistry, vol. 23, pp. 399–408, (1978).

Journal of Solid State Chemistry, vol. 5, pp. 229–238, (1972).

*Primary Examiner*—Howard S. Williams

*Attorney, Agent, or Firm*—James H. Dickerson, Jr.

[57] ABSTRACT

An uncoated ceramic anode comprising titanium having a formal valence of +4; titanium having a formal valence of +3; and a dopant which prevents at least a portion of the titanium +3 from converting to titanium +4 when the ceramic anode is at operating cell conditions. The ceramic anode may have an electrically conductive substance enclosed in its interior. The substance serves to transfer electrical energy from a power source to the ceramic member. These anodes are particularly useful when used in molten salt electrolytic cells because they give good electrolytic production rates while demonstrating exceptionally low wear rates.

9 Claims, No Drawings

ELECTROLYTIC CELL AND ANODE FOR MOLTEN SALT ELECTROLYSIS

BACKGROUND OF THE INVENTION

Dimensionally stable electrodes for anodic reactions in electrolysis cells have recently become of general use in the electrochemical industry replacing the consumable electrodes of carbon, graphite, etc.

Dimensionally stable electrodes generally comprise a valve metal base such as Ti, Ta, Zr, Hf, Nb, and W, which under anodic polarization develop a corrosion-resistant but nonelectrically conductive oxide layer or "barrier layer," coated over at least a portion of their outer surface with an electrically conductive and electrocatalytic layer of platinum group metal oxides or platinum group metals (see U.S. Pat. Nos. 3,711,385; 3,632,498 and 3,846,273). Electroconductive and electrocatalytic coatings made of or containing platinum group metals or platinum group metal oxides are, however, expensive and are eventually subjected to consumption or deactivation in certain electrolytic processes and, therefore, reactivation or recoating is necessary to reactivate exhausted electrodes.

When these electrodes are used in the electrolysis of molten salts, the valve metal support frequently is rapidly dissolved, since the thin protective oxide layer is either not formed at all or is rapidly destroyed by the molten electrolyte with the consequent dissolution of the valve metal base and loss of the noble metal coating.

Numerous patents have taught coatings for various dimensionally stable anodes (see, for example, U.S. Pat. Nos. 4,070,504 and 4,003,817).

Sintered electrodes having electrocatalytic coatings are taught by De Nora in U.S. Pat. No. 4,146,438. He teaches a self-sustaining matrix of sintered powders of an oxycompound of at least one metal selected from a group consisting of 37 metals (including titanium and tantalum) plus the metals of the lanthanide series and the actinide series with at least one electroconductive agent (zirconium oxide and/or tin oxide). He requires that the electrode surface be at least partially coated with at least one electrocatalyst (an oxide of cobalt, nickel, manganese, rhodium, iridium, ruthenium or silver).

Johnson et al. in U.S. Pat. No. 4,160,069 teach a current collector having a ceramic member of rutile which is doped with a polycrystalline ceramic having a valence of at least +5 which has an electrically conductive metal cladding intimately attached to a substantial portion of one surface of the ceramic member.

SUMMARY OF THE INVENTION

An uncoated ceramic anode comprising titanium having a formal valence of +4; titanium having a formal valence of +3; and a dopant which prevents at least a portion of the titanium +3 from converting to titanium +4 when the ceramic anode is at operating conditions. The ceramic anode may have an electrically conductive substance enclosed in its interior. The substance serves to transfer electrical energy from a power source to the ceramic member. These anodes are particularly useful when used in molten salt electrolytic cells because they give good electrolytic production rates while demonstrating exceptionally low wear rates.

DETAILED DESCRIPTION OF THE INVENTION

The ceramic body described herein is especially useful as an anode in molten salt electrolytic cells. When used as such, the ceramic anode has a lower wear rate than the wear rate of conventional graphite anodes when used under similar conditions. When used as anodes in an electrolytic cell producing magnesium from a molten salt, the present anodes show wear rates of less than about 20 millimeters per year and frequently wear rates of less than about 10 millimeters per year.

The anode of the present invention contains a mixture of Ti having a +4 formal valence; Ti having a +3 formal valence and a dopant. When $TiO_2$ ($Ti^{+4}$) is heated, a portion of the $Ti^{+4}$ converts to $Ti^{+3}$. However, upon cooling, the $Ti^{+3}$ reconverts to its original $Ti^{+4}$ state. It has been discovered that adding a dopant to ceramic materials which contain $Ti^{+4}$ and $Ti^{+3}$ will prevent at least a portion of the $Ti^{+3}$ from reconverting to $Ti^{+4}$ at cell operating conditions, resulting in an electrically conductive ceramic member. If the $Ti^{+3}$ were allowed to reconvert to $Ti^{+4}$, the ceramic member would be a very poor conductor and of little value as an electrode. When valences are referred to herein, formal valences are being discussed. Formal valences are well understood by those skilled in the art. Fused halide electrolytic cells normally operate at temperatures of from about 500° to 1100° C.

It has been discovered that when the herein described ceramic member is used as an anode in a molten salt electrolytic cell, the member works very well and is very resistant to wear. The member may be formed into an anode and used as is. However, such an anode should be relatively short because substantial amounts of current flowing through it will cause it to heat to an unacceptably high temperature. At temperatures above about 800° C., the titanium oxide in the anode may begin to react with halogens, such as chlorine, and cause degradation of the ceramic member. However, if the ceramic member is formed into a hollow structure and an electrically conductive substance is placed within the hollow interior, no overheating problems are encountered when the anode is used in an electrolytic cell.

One way of producing the anode of the present invention is forming a single-phase of titanium dioxide with a dopant. There may be more than one phase detected, however, the single phase referred to herein describes the titanium and the dopant forming a single phase.

The ceramic material may be formed into a single phase by admixing $TiO_2$ with one or more dopant materials followed by high temperature reaction. An acceptable method involves heating the admixture at about 1,000° C. for about 12 hours. The material may then be ground and refired for another 12 hours at 1,000° C. This procedure may be repeated until X-ray analysis of the powder shows it to be substantially a single phase.

Optionally, the material may be co-precipitated and then heated, as described above, until a single phase is formed.

Additionally, a slurry precipitation technique may be used. The slurry technique used dissolved metal chlorides, metal fluorides or metal nitrates added to a reasonably volatile alcohol. Pigment grade $TiO_2$ powder is added to that solution to form the slurry. The slurry is continually stirred until nearly dry, then dried to completion at 100° C. After a light grinding, the powder is ready for use. It is not a single phase material as in the co-precipitated preparation, but it does become single phase rutile upon sintering.

The dopants are present in relatively small amounts. Preferred composition ranges for the dopants are from about 0.1 mole percent to about 5 mole percent, while the $TiO_2$ is present at from about 95 mole percent to about 99.9 mole percent.

Dopants may be cation or anion dopants. Acceptable cation dopants include materials which have a valence of +5 or greater and have the capability of preventing at least a portion of any $Ti^{+3}$ present from converting to $Ti^{+4}$. Preferred dopants are compounds, metals or alloys containing $Ta^{+5}$ and/or $Nb^{+5}$, although other dopants meeting the chemical requirements may be used. Acceptable anion dopants are compounds having a formal valence of −1 which will cause at least a portion of the $Ti^{+4}$ remain as to $Ti^{+3}$. Preferred anion dopants are compounds containing $F^-$.

After the material has been converted to a single phase, the material may be formed into electrodes by known ceramic techniques such as isostatic pressing or slip casting. The electrodes may be of any desired shape and preferably have an electrically conductive substance as a core. The core may be graphite, metals such as platinum, or metal alloys. The core should be capable of conducting electrical energy from a power source to the ceramic electrode and should be substantially nonreactive with the ceramic at the cell operating conditions. Suitable metal alloys include alloys of tin, lead and indium. The core may be solid or liquid at the operating conditions depending upon the composition of the core.

One way of forming the electrode is to grind the single phase material (prepared according to the above-described procedures) into a powder form and pack it into a rubber tube which is being vibrated. The powder may be packed around a wire which extends the length of the tube or a spacer may be provided in the tube so that a hollow center is left. After packing the powder into the tube, the tube is sealed and the remaining air is evacuated. The tube is then subjected to a pressure of approximately 20,000 to 50,000 pounds per square inch gauge (psig) in an isostatic press. The prepared ceramic body is then sintered. A suitable sintering condition for platinum wire core samples is heated at about 1,500° C. for about one hour.

The electrodes may be used as anodes in electrolytic cells. It is especially useful in molten salt eletrolytic cells such as those for the production of magnesium or aluminum. When used in such cells, the wear rate of the anode is greatly reduced, when compared to the wear rate of conventional graphite anodes. Ceramic anodes of the present invention have a wear rate of about 12 millimeters per year or less. Such a decrease in wear rate marks a substantial improvement in the operation of molten salt electrolytic cells. Various titanium compounds may be used as starting materials including titanium oxides and chlorides. Likewise, the dopant may include various compounds such as tantalum or niobium halides.

EXAMPLES OF THE INVENTION

EXAMPLE 1

$TiO_2$ powder, 95 g, and $Ta_2O_5$ powder, 13.896 g were hand mixed and packed in a combustion boat for a 12-hour prefiring at 1,000° C. The material was hand ground, repacked, and refired for 12 hours at 1,000° C. After the second firing, a powder X-ray pattern was taken to see if the titanium and tantalum had formed a single-phase. A total of six firing cycles were performed as decribed above. A ceramic rod with a Pt core was fabricated. A rubber tube was put into a close fitting tubular metal form. Powder was put into the rubber tube, added in small amounts, while the metal form was forced to vibrate. After each addition, the powder was gently packed around a one-tenth inch Pt wire using a smooth, snug fitting glass tube. The rubber tube was sealed with a rubber stopper. A hypodermic needle through the stopper was used to evacuate the rubber tube. The evacuated sealed rubber tube was pressed at 20,000 psig in a isostatic press. A sample with two exposed Pt ends was treated with a water slurry of the powder to cover one exposed end. This and other Pt core samples were sintered at 1,500° C. for 1 hour.

EXAMPLE 2

A rod prepared according to Example 1 was tested as an anode in a laboratory beaker cell. The cell was a 250 ml quartz crucible containing molten chloride salts at about 700° C. A mild steel rod cathode and the test anode were lowered into the molten salt. The temperature was monitored using a thermocouple in a quartz tube. The performance of the anode was observed from current densities near zero to 6 amps per square inch.

The electrode's starting weight was 23.2216 g with a diameter of 0.207 inch and a surface area of 0.684 $inch^2$ at a one inch depth in the cell bath. The anode was run at 4 to 6 $A/inch^2$ at 720° C. in a $MgCl_2$ molten salt bath. The final weight was 23.2116 g after a 4-hour test. This resulted in a wear rate of 12.1 mm/year.

EXAMPLE 3

A ceramic anode having a molten metal core consisting of a 50% Pb—50% In alloy was tested in the electrolytic cell described in Example 2. The current density was maintained at 4.5 amps per square inch. After a 28-day test, the cell operation was stopped and the wear rate of the anode was found to be 3.3 mm per year.

What is claimed is:

1. An electrode for the electrolysis of molten salts comprising:

(a) an uncoated, uncatalyzed hollow ceramic member which comprises a single phase material of an oxide of titanium and a dopant suited to prevent at least a portion of titanium ions having a formal valence of +3 from converting to titanium ions having a formal valence of +4; and (b) an electrically conductive substance occupying at least a portion of the interior of the hollow ceramic member and adapted to transfer electrical energy from a power source to the ceramic member.

2. An anode for the electrolysis of molten salts comprising an electrically conductive substance at least partially surrounded by an uncoated, uncatalyzed, sintered, ceramic member formed from an oxide of titanium and a dopant which prevents at least a portion of titanium ions having a formal valence of +3 from converting to titanium ions having a formal valence of +4 when the ceramic member is at operating temperatures of a molten salt electrolytic cell.

3. The anode of claims 1 or 2 wherein the dopant is selected from the group consisting of materials containing niobium, tantalum or fluoride ions or mixtures thereof.

4. The anode of claims 1 or 2 wherein the electrically conductive substance is a metallic wire.

5. An improved electrolytic cell comprising an anode, a cathode, means to impose an electrical potential on the anode and the cathode, and means to remove the products of electrolysis, wherein the improvement comprises using as the anode the anode of claims 1 or 2.

6. The anode of claims 1 or 2 wherein the electrically conductive substance is a metal or a metal alloy.

7. An electrode for the electrolysis of molten salts comprising:

(a) a hollow ceramic member which comprises as a single phase material a dopant suited to prevent at least a portion of titanium ions having a formal valence of +3 from converting to titanium ions having a formal valence of +4 and about 95 to about 99.9 mole percent of an oxide of titanium; and (b) an electrically conductive substance occupying at least a portion of the interior of the hollow ceramic member and adapted to transfer electrical energy from a power source to the ceramic member.

8. The electrode of claim 7 wherein the dopant is present in an amount of about 0.1 to about 5 mole percent.

9. The electrode of claims 7 and 8 wherein the dopant is selected from the group consisting of materials containing niobium, tantalum or fluoride ions or mixtures thereof.

* * * * *